US010221630B2

(12) United States Patent
Anderle et al.

(10) Patent No.: US 10,221,630 B2
(45) Date of Patent: Mar. 5, 2019

(54) ANODIC BONDING OF THERMALLY STABLE POLYCRYSTALLINE MATERIALS TO SUBSTRATE

(71) Applicant: HALLIBURTON ENERGY SERVICES, INC., Houston, TX (US)

(72) Inventors: Seth Garrett Anderle, Spring, TX (US); William Brian Atkins, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 425 days.

(21) Appl. No.: 14/784,246

(22) PCT Filed: Sep. 11, 2014

(86) PCT No.: PCT/US2014/055047

§ 371 (c)(1),
(2) Date: Oct. 13, 2015

(87) PCT Pub. No.: WO2015/038687

PCT Pub. Date: Mar. 19, 2015

(65) Prior Publication Data

US 2016/0076308 A1 Mar. 17, 2016

Related U.S. Application Data

(60) Provisional application No. 61/876,260, filed on Sep. 11, 2013.

(51) Int. Cl.
*B22F 5/00* (2006.01)
*B22F 7/06* (2006.01)
(Continued)

(52) U.S. Cl.
CPC ..... *E21B 10/5735* (2013.01); *B22F 7/064* (2013.01); *C22C 26/00* (2013.01); *C22C 29/06* (2013.01); *B22F 2005/001* (2013.01)

(58) Field of Classification Search
CPC ..... E21B 10/5735; B22F 7/064; B22F 2005/001; C22C 26/00; C22C 29/06
See application file for complete search history.

(56) References Cited

U.S. PATENT DOCUMENTS 7,487,849 B2 2/2009 Radtke
8,529,724 B2 9/2013 Tudryn et al.
(Continued)

FOREIGN PATENT DOCUMENTS

CN 1034879 8/1989
CN 103201451 7/2013
(Continued)

OTHER PUBLICATIONS

Briand et al., Bonding Properties of Metals Anodically Bonded to Glass, Sensors and Actuators A: Physical 114, issues 2-3, 2004, p. 543-549.

(Continued)

*Primary Examiner* — Pegah Parvini
(74) *Attorney, Agent, or Firm* — Kilpatrick Townsend & Stockton LLP

(57) ABSTRACT

Cutting elements and other hardfacing components of a drill bit or other downhole equipment are provided that include a thermally stable polycrystalline material anodically bonded to a substrate. Methods and systems for making such elements and components are also provided.

16 Claims, 6 Drawing Sheets

(51) Int. Cl.

| | |
|---|---|
| ***C22C 26/00*** | (2006.01) |
| ***C22C 29/06*** | (2006.01) |
| ***E21B 10/573*** | (2006.01) |

(56) References Cited

U.S. PATENT DOCUMENTS

| | | | | |
|---|---|---|---|---|
| 2004/0197949 | A1 | 10/2004 | Hata et al. | |
| 2004/0207697 | A1 | 10/2004 | Conta | |
| 2006/0134466 | A1 | 6/2006 | Aoki | |
| 2006/0266558 | A1* | 11/2006 | Middlemiss | B22F 7/062 175/426 |
| 2008/0035389 | A1 | 2/2008 | Hall et al. | |
| 2008/0230280 | A1* | 9/2008 | Keshavan | C22C 1/05 175/434 |
| 2010/0186304 | A1* | 7/2010 | Burgess | B22F 7/02 51/309 |
| 2010/0243337 | A1 | 9/2010 | Scott | |
| 2011/0088954 | A1* | 4/2011 | DiGiovanni | C04B 35/52 175/336 |
| 2012/0080239 | A1 | 4/2012 | Lyons et al. | |
| 2012/0103698 | A1* | 5/2012 | DiGiovanni | E21B 10/5735 175/428 |
| 2013/0168158 | A1 | 7/2013 | Belnap et al. | |

FOREIGN PATENT DOCUMENTS

| | | |
|---|---|---|
| EP | 1462422 | 9/2004 |
| WO | 2005080742 | 9/2005 |
| WO | 2010117834 | 10/2010 |

OTHER PUBLICATIONS

Briand et al., Metal to Glass Anodic Bonding for Microsystems Packaging, The 12th International Conterence on Solid Stale Sensors Actuators and Microsystems, Boston, Jun. 8-12, 2003, p. 1824-1827.

International Patent Application No. PCT/US2014/055047 , International Search Report & Written Opinion, dated Dec. 17, 2014, 14 pages.

Canadian Patent Application No. 2,912,192, Office Action, dated Aug. 25, 2016, 3 pages.

Chinese Patent Application No. 201480030413.2, Office Action, dated Aug. 2, 2016, 24 pages.

Canadian Patent Application No. 2,912,192, Office Action, dated Apr. 10, 2017, 3 pages.

Chinese Patent Application No. 201480030413.2 , Office Action, dated Mar. 9, 2017, 11 pages.

Canadian Patent Application No. 2,912,192, "Office Action", dated Dec. 8, 2017, 3 pages.

* cited by examiner

ANODIC BONDING OF THERMALLY STABLE POLYCRYSTALLINE MATERIALS TO SUBSTRATE

CROSS-REFERENCE TO RELATED APPLICATIONS

This is a U.S. national phase under 35 U.S.C. 371 of International Patent Application No. PCT/US2014/055047, titled "Anodic Bonding of Thermally Stable Polycrystalline Materials to Substrate" and filed Sep. 11, 2014, which claims priority to U.S. Provisional Application No. 61/876,260, titled "Anodic Bonding of Thermally Stable Polycrystalline Materials to Substrate" and filed Sep. 11, 2013, the entirety of each of which is incorporated herein by reference.

TECHNICAL FIELD

The present disclosure relates generally to cutting elements and other downhole drilling components that include thermally stable polycrystalline materials usable in connection with wellbore drilling and systems and methods of manufacture using anodic bonding.

BACKGROUND

Rotary drill bits are frequently used to drill oil and gas wells, geothermal wells, and water wells. Fixed cutter drill bits or drag bits are often formed with a bit body having cutting elements or inserts disposed at select locations of exterior portions of the bit body. Drill bits and other downhole equipment may also have a variety of other abrasive and/or wear-resistant, hardfacing elements. Cutting elements and hardfacing elements can be made from polycrystalline materials.

For example, cutting elements having a polycrystalline cutting layer (or table) have been used in industrial applications including wellbore drilling and metal machining for many years. One such material is a polycrystalline diamond (PCD), which is a polycrystalline mass of diamonds (typically synthetic) that is bonded together to form an integral, tough, high-strength mass. To form a cutting element, a cutting layer is bonded to a substrate material, which is typically a sintered metal-carbide. When bonded to a substrate, a PCD is referred to as a polycrystalline diamond compact (PDC). Polycrystalline materials for use in cutting elements or hardfacing structural elements can also be made from other polycrystallline materials such as polycrystalline cubic boron nitride (PCBN).

Methods for securing thermally stable polycrystalline material to a substrate for use in drill bit cutting element, or other abrasive and/or wear-resistant, hardfacing structural element that are part of a drill bit body or other downhole equipment have been actively investigated. High temperature high pressure (HTHP) processing is a common method of attachment. However, this method typically uses another catalyst, such as cobalt, and results in reduced thermal stability of the polycrystalline material.

DETAILED DESCRIPTION

Figure 1:
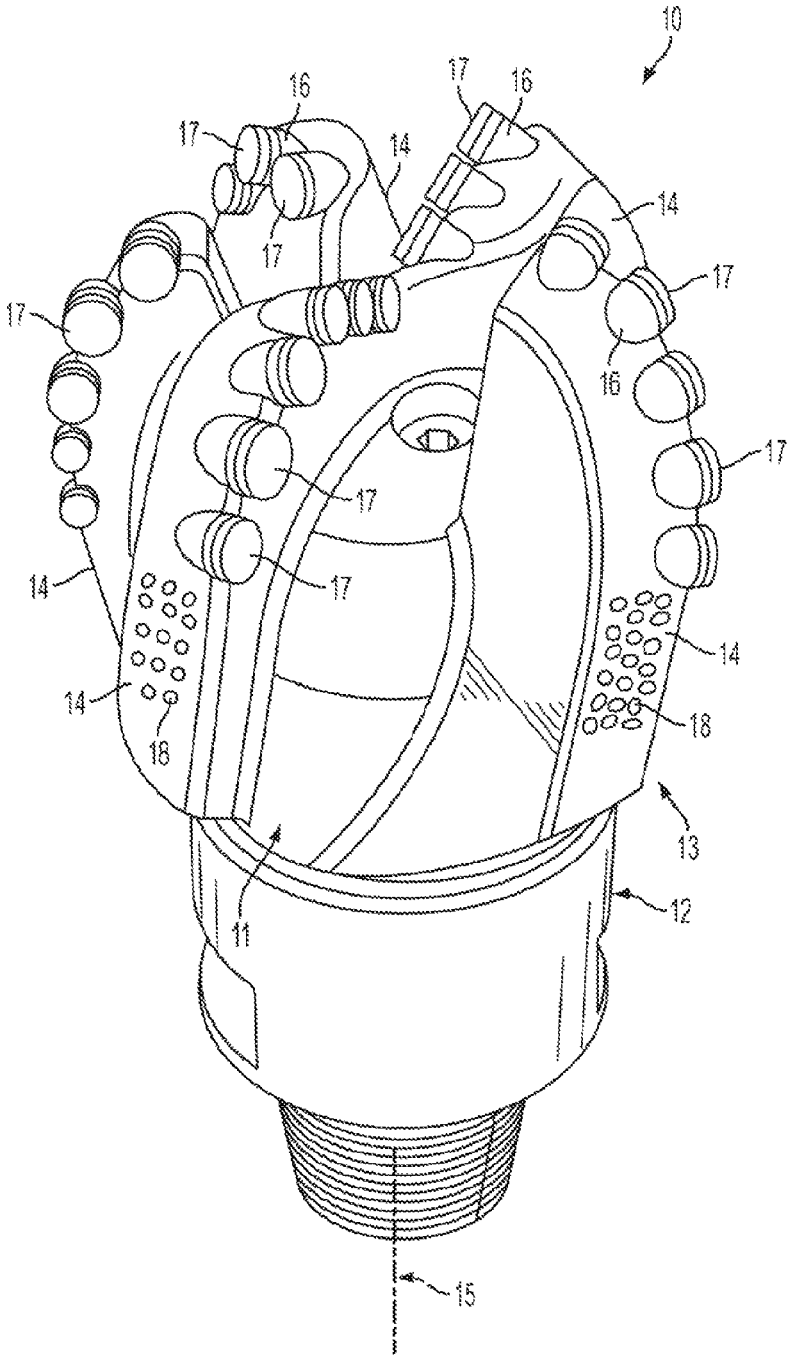
FIG. 1 is a perspective view of a drill bit containing cutting elements according to one embodiment.

Certain embodiments and features of the present disclosure relate to cutting elements and hardfacing components of drill bits and other downhole equipment that include thermally stable polycrystalline material and can be used in connection with wellbore drilling and systems, as well as methods of manufacturing such elements using anodic bonding. In some examples, a cutting element having a thermally stable polycrystalline material cutting layer can be attached to a drill bit head or other downhole equipment, such as a reamer or a hole opener, that can be used to break apart, cut, or crush rock and earth formations when drilling a wellbore, such as those drilled to extract water, gas, or oil. In another example, a hardfacing component having a thermally stable polycrystalline material outer-facing layer can be attached to a drill bit or other downhole equipment. Such hardfacing components may be wear-resistant, reducing susceptibility of the drill bit or downhole equipment to damage due to frictional heat and may facilitate movement of the equipment downhole during use. Examples of hardfacing components include drill bit heads, gage protectors, and impact arrestors. An electrical field can be used to covalently bond the thermally stable polycrystalline material to a substrate to form the cutting element or hardfacing component. In some examples, anodic bonding of the thermally stable polycrystalline material to the substrate or hardfacing component maximizes the thermal stability of the cutting element or hardfacing component. As a result, the cutting element or hardfacing component can have improved thermo-mechanical integrity and abrasion resistance, and has reduced leaching exposure compared to those made using conventional methods of attaching a cutting layer to a substrate.

A PCD includes individual diamond "crystals" that are interconnected in a lattice structure. A metal catalyst (in particular, Group VIII metal catalysts), such as cobalt, has been used to promote recrystallization of the diamond particles and formation of the lattice structure (for example, in a sintering process). However, Group VIII metal catalysts have significantly different coefficient of thermal expansion (CTE) as compared to diamond and, upon heating a PCD, the metal catalyst and the diamond lattice will expand at different rates, causing cracks to form in the lattice structure and resulting in deterioration of the cutting layer (during downhole use). Also, at elevated temperatures (>800° C.) and in the absence of elevated pressure, the metal catalyst will also revert the diamond to graphite. In order to obviate this problem, strong acids may be used to "leach" the cobalt from the diamond lattice structure, generating a thermally stable polycrystalline diamond material. Similar issues occur and must be addressed for other polycrystalline materials. Cutting elements with a cutting layer of thermally stable polycrystalline material have relatively low wear rates, even as cutter temperatures reach 1200° C.

In some cases, the polycrystalline material is made of diamond or other superhard particles bound together with a binder (for example, silicon) in a matrix composite. Hardfacing components may include this type of polycrystalline material as an abrasive and/or wear-resistant feature.

For simplicity, features of a drill bit cutting element that includes a thermally stable polycrystalline material cutting layer made from a polycrystalline diamond (PCD), along with systems and methods for making and using this component, are described in detail. However, such features similarly relate to abrasive or wear-bearing hardfacing components of a drill bit or other downhole equipment, along with systems and methods for making and using such components. Such features also similarly relate to components containing other polycrystalline materials, along with systems and methods for making and using such components.

In one example, a cutting element that includes a cutting layer made of thermally stable polycrystalline material anodically bonded to a substrate is attached to a drill bit for earth formation drilling. A fixed cutter drill bit 10 having such cutting elements is shown in FIG. 1. The bit head 11 is connected to a shank 12 to form a bit body 13. A plurality of cutter blades 14 are arranged around the circumference of the bit head 11. In this example, there are five cutter blades 14 that extend generally outwardly away from a rotational axis 15 of the drill bit. Pockets or recesses 16, otherwise called sockets and receptacles, are formed on the cutter blades 14. Cutting elements 17, otherwise known as inserts, are fixedly installed in each pocket 16, for example by brazing. A plurality of cutting elements 17 are disposed side by side along the length of each blade. The number of cutting elements 17 carried by each blade may vary. As the drill bit 10 is rotated in use, it is the cutting elements 17 that come into contact with the formation, in order to dig, scrape or gouge away the material of the formation being drilled. Gage protectors 18 are located on the outward-facing surface of the plurality of cutter blades 14, where they facilitate rotation of the bit body 13 and provide wear resistance.

Figure 2:
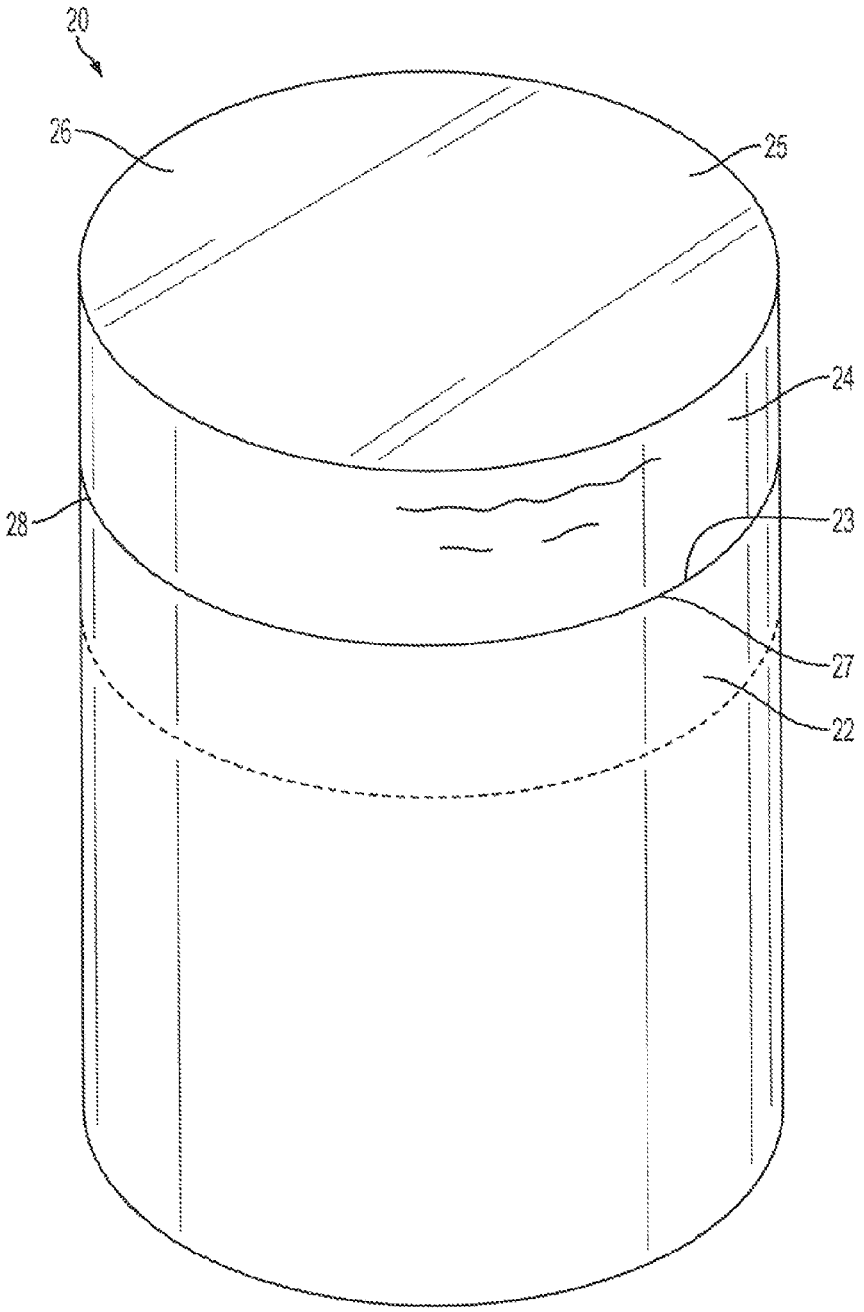
FIG. 2 is perspective view of a cutting element having a cutting layer of thermally stable polycrystalline material attached to a substrate according to one embodiment.

In another example, a cutting element 20 that includes a thermally stable polycrystalline material anodically bonded to a substrate is shown in FIG. 2. The cutting element 20 has a cylindrical substrate body (substrate) 22 having an end face or upper surface 23 referred to herein as the interface surface 23. An ultra-hard material layer (cutting layer) 24 forms the working surface 25 and the cutting edge 26. A bottom surface 27 of the cutting layer 24 is anodically bonded on to the upper surface 23 of the substrate 22. The joining surfaces 23 and 27 are herein referred to as the interface 28. The interface 28 is where surface 23 of the substrate 22 are covalently attached to each other by anodic bonding. The top exposed surface or working surface 25 of the cutting layer 24 is opposite the bottom surface 27. The cutting layer 24 typically may have a flat or planar working surface 25, or a non-planar surface (not shown separately).

For example, the cutting layer 24 can include a thermally stable polycrystalline material. The thermally stable polycrystalline material may include polycrystalline diamond, polycrystalline cubic boron nitride, or another super abrasive material. The substrate 22 may be a carbide or a metal. For example, the carbide may include cemented tungsten carbide (WC), silicon carbide (SiC), or another super hard material. Where the substrate 22 is a metal, the metal may include steel, a nickel/iron alloy, Invar, or titanium. Examples of substrates include metals (for example, steel, invar, titanium, etc.), silicon-coated metals, silicon-coated and cemented tungsten carbide, and silicon carbide. Either or both of the cutting layer 24 and the substrate 22 can be plated, layered, or coated with metal or silicon to facilitate the anodic bonding process. In some examples, the substrate 22 may be a carbide or a metal that includes, or is covalently coated with, silicon.

The cutting layer 24 may be anodically bonded to the substrate 22 directly or may be anodically bonded to an interlayer that is bonded to the substrate 22. In certain examples, the cutting layer 24 may be bonded to the substrate 22 indirectly via an interlayer (FIG. 2, not shown). The upper surface of the interlayer can be anodically bonded to the bottom surface 27 of the cutting layer 24. The interlayer may be substance that forms a carbide that can be bonded to a polycrystalline material of the cutting layer 24. For example, the interlayer may be a metal, such as steel, a nickel/iron alloy, Invar, or titanium. The interlayer may be made of multiple substances that have different affinities for each other, for the substrate 22, and for the polycrystalline material. The interlayer may also be multiple layers of different substances that have different affinities for each other, for the substrate, and for the polycrystalline material of the cutting layer 24. In some examples, the interlayer may be a metal covalently coated with silicon. The metal of the interlayer may be ductile to absorb residual stresses from both the anodic bonding process as well as, for example, the brazing process that may be used to bond the thermally stable polycrystalline material-interlayer to the substrate 22. Residual thermal stress can be managed by a single interlayer or multiple interlayers.

Figure 3A:
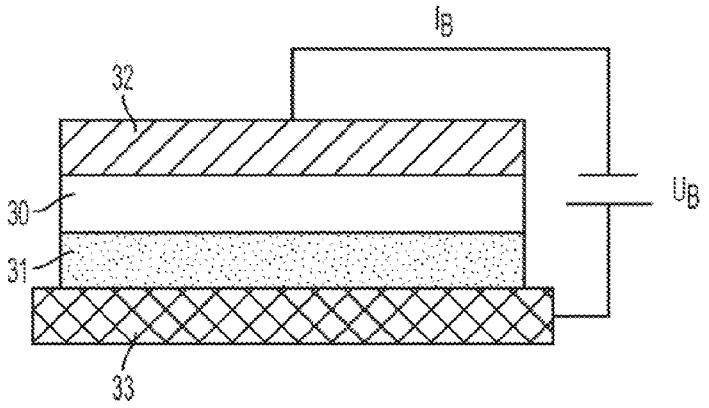
FIG. 3A is a schematic illustrating the components for performing an anodic bonding procedure. Some process parameters are bond voltage ($U_B$), current limitation ($I_B$), and bond temperature ($T_B$).

A drill bit 10 as shown in FIG. 1 may be made using anodic bonding to attach the cutting layer 24 to the substrate 22 or the interlayer. Anodic bonding can be used to covalently bond a first material 30 to a second material 31, as shown in FIG. 3A. The first material 30 and the second material 31 are placed adjacent to each other and positioned between a cathode 32 and an anode 33. An electrostatic field is generated by applying an electrical current to the anode that can attract or repel positive and negative charged ions present in the first material 30 or the second material 31 to generate a covalent bond between the two materials. As the first material and second material are solid, the ion drift generated by the electrostatic field occurs at the surface of the two materials to facilitate their covalent bonding. In some examples, the anode and the cathode further include heating elements for applying heat to the first material and the second material to facilitate anodic bonding. The anodic bonding process may be performed inside a temperature-controlled environment. Parameters of the anodic bonding process include bond voltage ($U_B$), current limitation ($I_B$), bond temperature ($T_B$), as well as contact pressure and time.

Figure 3B:
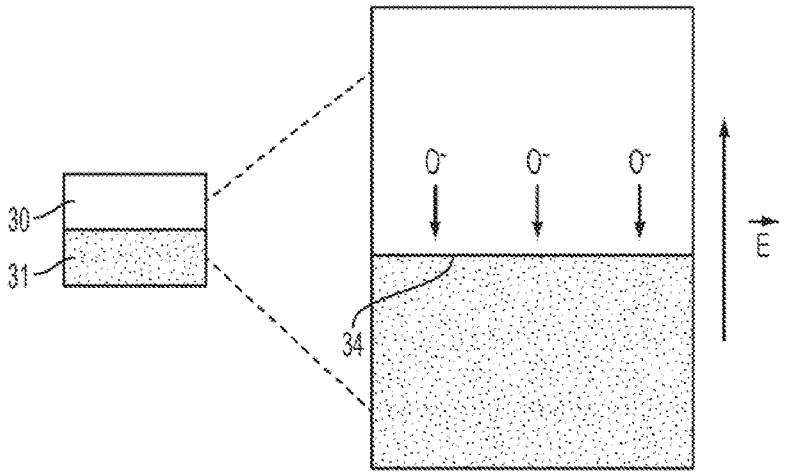
FIG. 3B is a schematic illustrating the ionic drift associated with the anodic bonding process of FIG. 3A.

For example, anodic bonding has been used to covalently bond glass to a second material such as silicon, metal, or other materials. In this context, anodic bonding can involve positioning a first material 30, such as glass, and a second material 31, such as silicon, in atomic contact through an electrostatic field. The electrostatic field can attract or repel positive and negative charged ions present in the glass as shown in FIG. 3B. The glass can include a high concentration of alkali or alkaline ions (for example, $Na^{2+}$). The positively charged ions drift toward the cathode, forming a "depletion zone" at the glass surface adjacent to the second material 31, while the negatively charged ions drift into the depletion zone toward the interface 34 between the glass surface and the second material. At the interface 34, the negative charged ions (such as oxygen) can react with the second material (for example, silicon) to form a covalent oxide bonding layer (such as, silicon oxide).

In using anodic bonding as a mechanism for attaching a thermally stable polycrystalline material cutting layer to a substrate for use in a drill bit, the characteristics of the thermally stable polycrystalline material and the substrate (and the interlayer, if included) should be considered.

For example, a factor in selecting the thermally stable polycrystalline material, the substrate, and the interlayer (or interlayers) can be the coefficient of thermal expansion (CTE) of each. CTE is the fractional increase in the length per unit rise in temperature for a material. The differential in CTE between the substrate and the thermally stable polycrystalline material may result in thermal residual stress, which can cause the thermally stable polycrystalline material to crack upon being cooled. To minimize problems caused by thermal residual stress, the CTE of the thermally stable polycrystalline material may be similar to that of the substrate or to the interlayer if an interlayer is used.

Figure 4A:
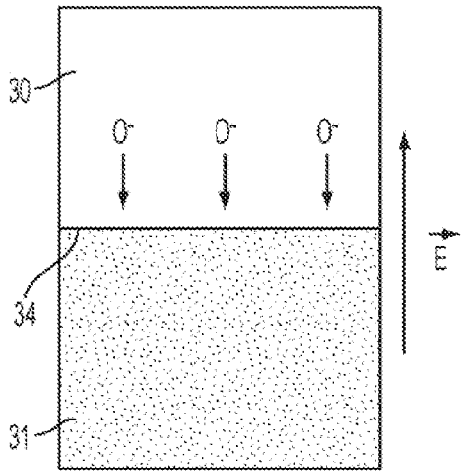
FIG. 4A is a schematic showing the ionic drift associated with anodic bonding of carbonate-containing thermally stable polycrystalline material to a substrate according to one embodiment.

A glass or alkali or alkaline can be added to the thermally stable polycrystalline material (which does not typically contain glass or such ions) either during the pressing process or post pressing to facilitate anodic bonding to a substrate. For example, typical crystallization Group VIII metal catalysts, such as cobalt and nickel, can be replaced with a carbonate catalyst. Carbonate catalysts can provide the ions utilized for anodic bonding. Examples of such carbonate catalysts include magnesium carbonate ($MgCO_3$), silicon carbonate (SiCO), sodium carbonate ($Na_2CO_3$), potassium carbonate ($K_2CO_3$), strontium carbonate ($SrCO_3$), calcium carbonate ($Ca_2CO_3$), and lithium carbonate ($Li_2CO_3$). In some examples, multiple carbonate catalysts are used to form the thermally stable polycrystalline material. Unlike metal catalysts, carbonate catalysts do not function as a catalyst after the press cycle in forming the polycrystalline material. Thus, removal of the carbonate catalyst from the polycrystalline material (for example, by leaching) to generate a fully thermally stable polycrystalline material is not necessary. As shown in FIG. 4A, the negatively charged oxygen ions present in the thermally stable polycrystalline material may drift into the depletion zone toward the interface 34 between the thermally stable polycrystalline material (first material 30) and the substrate (second material 31). At the interface 34, the oxygen ions can react with the second material to form a covalent oxide bonding layer, thereby covalently attaching the thermally stable polycrystalline material (first material 30) to the substrate (second material 31).

Figure 4B:
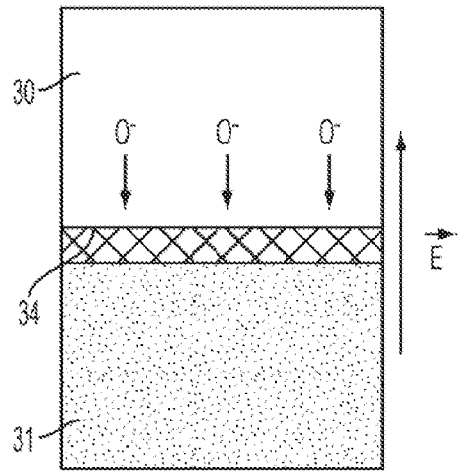
FIG. 4B is a schematic showing the ionic drift associated with bonding of carbonate-containing thermally stable polycrystalline to silicon-coated substrate according to one embodiment.

In some examples, the substrate may be covalently coated with a layer of silicon to facilitate the anodic bonding process. As shown in FIG. 4B, the negatively charged oxygen ions present in the thermally stable polycrystalline material drift into the depletion zone toward the interface 34 between the thermally stable polycrystalline material (first material 30) and the silicon layer on the substrate (second material 31). At the interface 34, the oxygen ions can react with the silicon to form a covalent silicon oxide bonding layer. The interlayer can then be attached to the substrate to form the drill bit (for example, by sintering). More than one interlayer 34 may be used to attach the thermally stable polycrystalline material (first material 30) to the substrate (second material 31).

Figure 5:
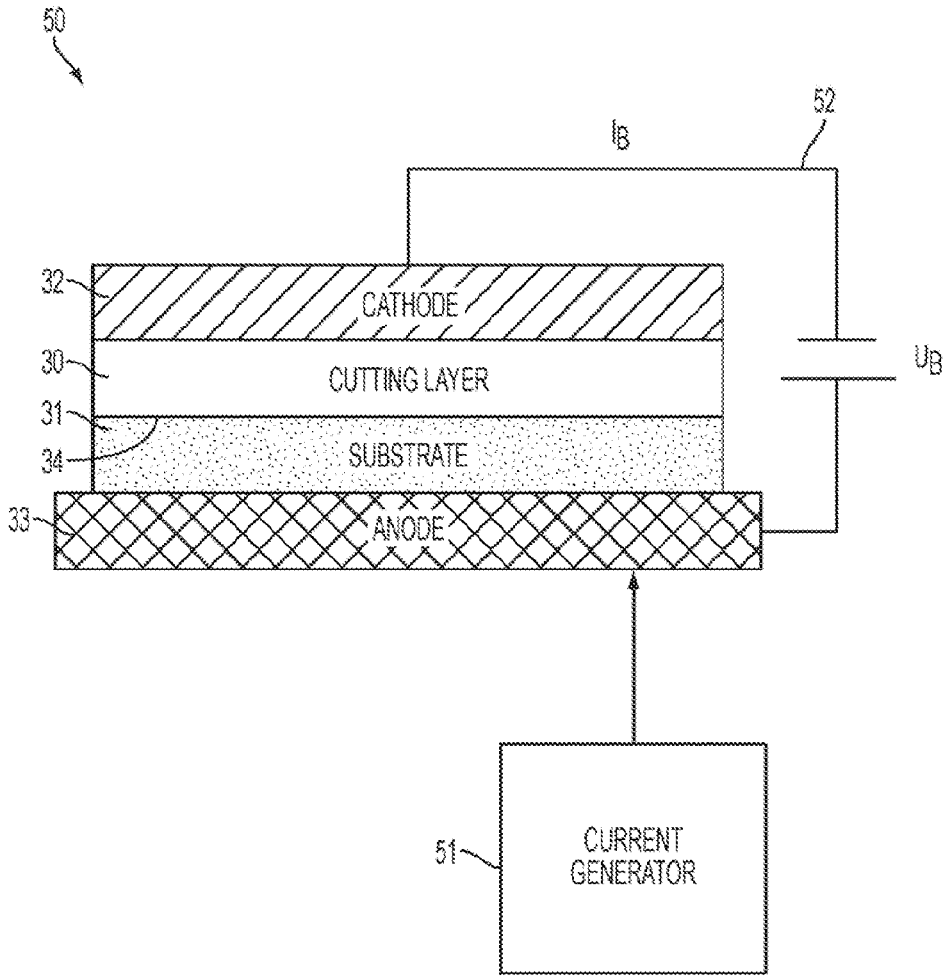
FIG. 5 is a schematic of a system for bonding a cutting layer of thermally stable polycrystalline material to a substrate to form a cutting element according to one embodiment.

FIG. 5 is a block diagram illustrating systems for making a cutting element according to certain embodiments. For example, the system 50 includes an anode 33, a cathode 32, a first material 30 that is a cutting layer (a thermally stable polycrystalline material), and a second material 31 that is a substrate in contact with the cutting layer, and a current generator 51. The cutting layer (first material 30) and the substrate (second material 31) are disposed between the anode 33 and the cathode 32, with anode 33 in contact with the cutting layer (first material 30), and the cathode 32 in contact with the substrate (second material 31). The current generator 51 sends a current from the anode to the cathode to generate an electric field 52 and cause anodic bonding between the cutting layer (first material 30) and the substrate (second material 31).

Heating the thermally stable polycrystalline material and the substrate (or interlayer), as the electrical current is being delivered to the thermally stable polycrystalline material and the substrate, can facilitate the movement of ions to improve anodic bonding. The temperature at which the anodic bonding process occurs influences the amount of time it will take for the bonding to occur. At cooler temperatures, the bonding process may proceed slowly, while at warmer temperatures, the bonding process may occur more quickly. Another factor in selecting the bonding temperature is the temperature at which the bonds of the thermally stable polycrystalline layer degrade. The lower the temperature at which bonding occurs, the lower the residual stress may be in the bonding layer due to geometric changes from the coefficient of thermal expansion (CTE). For example, a thermally stable polycrystalline diamond material can have a maximum temperature limit of approximately 800-1200° C. (depending on atmospheric conditions) at which the diamond bonds begin to break down in the thermally stable polycrystalline material. Thus, in some cases, the temperature selected for the anodic bonding process is as warm as the thermally stable polycrystalline material can be heated with minimal or no degradation. In some examples, the temperature selected for the anodic bonding process may be below the temperature at which the bonds of the thermally stable polycrystalline layer degrade but high enough to increase the rate at which the anodic bonding process occurs. In some examples, the anodic bonding process can involve using relatively low temperatures for bonding. Another factor that can increase the rate of the anodic bonding process is the strength of the electrostatic field. For example, the strength of the electrostatic field can be increased to encourage movement of ions. Increasing the strength of the electrostatic field may also cause the thermally stable polycrystalline material and the substrate (or interlayer) to heat.

In some cases, the temperature for the anodic bonding process may be much lower than the temperature used to debond the joint. For example, for a polycrystalline diamond material, an anodic bond may be created, as the electrical current is being delivered to the thermally stable polycrystalline material and the substrate, at a temperature below 800° C. In some instances, however, the polycrystalline diamond material may be heated to a temperature at or above 800° C. to debond. In some instances, the anodic bonding temperatures, as the electrical current is being delivered to the thermally stable polycrystalline material and the substrate, can be increased, for example, to about 1,000° C., to increase mobility of ions in the thermally stable polycrystalline material and the substrate. The anodic bonding process may be performed such that the thermally stable polycrystalline material is heated, as the electrical current is being delivered to the thermally stable polycrystalline material and the substrate, to a temperature between about 100° C. and about 900° C., or between about 200° C. and about 800° C., or between about 200° C. and about 700° C., or between about 200° C. and about 600° C., or between about 400° C. and about 800° C., or between about 400° C. and about 700° C., or between about 400° C. and about 600° C. For example, the thermally stable polycrystalline material may be heated, as the electrical current is being delivered to the thermally stable polycrystalline material and the substrate, to at least about 100° C., about 200° C., about 300° C., about 400° C., about 500° C., about 600° C., about 700° C., or about 800° C.

In some instances, a heating element is used to for apply heat to the cutting layer (thermally stable polycrystalline material), the substrate (or interlayer), or both the cutting layer and the substrate (or interlayer), to facilitate anodic bonding. In certain examples, the cathode 32 and anode 33 may directly provide heat to the cutting layer and the substrate (or interlayer) as a result of generating an electrostatic field. Alternatively, the anodic bonding process may be performed in an enclosed compartment for heating (for example, a furnace).

Figure 6:
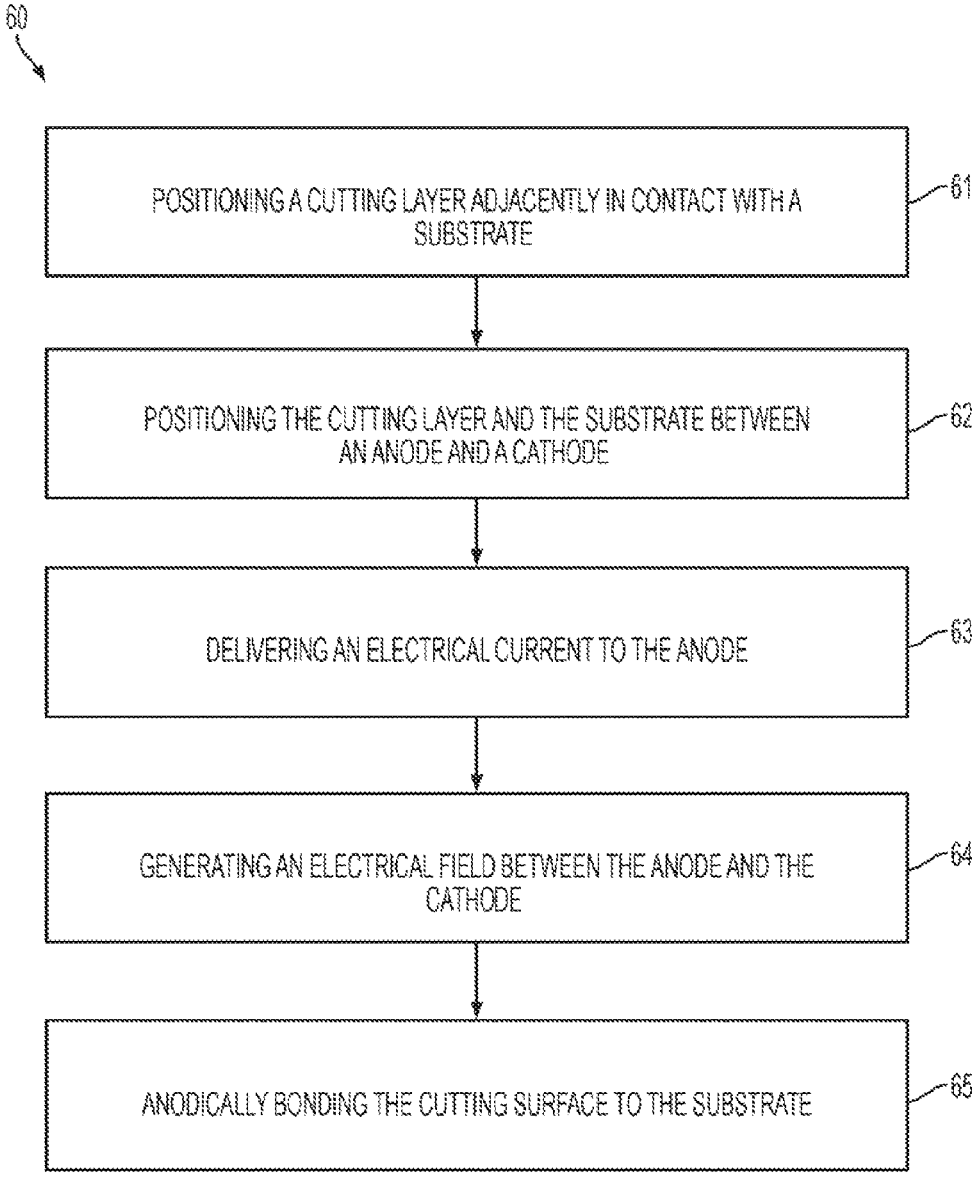
FIG. 6 is a block diagram of a method of making a cutting element having a cutting layer of thermally stable polycrystalline material attached to a substrate according to one embodiment.

FIG. 6 is a block diagram illustrating methods for making a cutting element according to various embodiments. The method 60 shown in FIG. 6 is described with respect to the environment shown in FIG. 5. In block 61, a cutting layer (first material 30; a thermally stable polycrystalline material) is positioned in contact with a substrate (second material 31; for example, a carbide). In block 62, the cutting layer and the substrate are positioned between an anode 33 and a cathode 32. Once positioned in the system, the cutting layer is in contact with the anode 33, and the substrate is in contact with the cathode 32. Applying the electrical current to the anode 33 generates an electrical field 52 between the anode 33 and the cathode 32 as indicated in block 64. In block 65, the electrical field 52 causes the cutting layer to be anodically bonded to the substrate, thus forming the cutting element. The electrical current is provided by the current generator 51.

To facilitate positioning of the cutting layer and the substrate between them, at least one of the anode and the cathode can be in a fixed position while the other is moveable. The anode and the cathode may both moveable. Positioning the components of the system may be performed manually or robotically using an assembly system. The system may include one or more sensors to facilitate positioning of the various components (not shown). In block 63, an electrical current is delivered to the anode once the cutting layer and the substrate are positioned between the anode and the cathode.

In some examples, the method further includes heating the cutting layer or the substrate when the electrical current is being delivered to the anode 33. In certain examples, the anode 33, the cathode 32, or both, include a heating element. In some cases, the anode 33, the cathode 32, or both, act as a heating element that heat the thermally stable polycrystalline material when the electrical current is delivered to the anode 33. See, for example, FIG. 5. Alternatively, the anodic bonding process can be performed in an enclosed compartment for heating (such as, for example, a furnace). In some instances, the thermally stable polycrystalline material is heated to at least 100° C. during the bonding process. In some examples, the thermally stable polycrystalline material is heated to temperatures in the ranges described above during the bonding process.

The features described herein may provide a cutting element or hardfacing component with improved wear according to one or more of the following examples.

EXAMPLE 1

A component includes a cutting layer of a substrate and a thermally stable polycrystalline material anodically bonded to the substrate.

EXAMPLE 2

The component of Example 1 can feature thermally stable polycrystalline material comprising polycrystalline diamond, or cubic boron nitride.

EXAMPLE 3

The component of any of Examples 1 to 2 can feature thermally stable polycrystalline material comprising a carbonate.

EXAMPLE 4

The component of any of Examples 1 to 3 can feature a carbonate comprising at least one of magnesium carbonate, silicon carbonate, sodium carbonate, potassium carbonate, strontium carbonate, calcium carbonate, or lithium carbonate.

EXAMPLE 5

The component of any of Examples 1 to 4 can feature substrate comprising a carbide or a metal.

EXAMPLE 6

The component of any of Examples 1 to 5 can feature a carbide substrate comprising cemented tungsten carbide or silicon carbide.

EXAMPLE 7

The component of any of Examples 1 to 6 can feature a metal substrate comprising steel, a nickel/iron alloy, Invar, or titanium.

EXAMPLE 8

The component of any of Examples 1 to 7 can feature a metal substrate comprising nickel or cobalt.

EXAMPLE 9

The component of any of Examples 1 to 8 can feature carbide substrate or metal substrate comprising silicon, or comprising carbide or metal that are covalently coated with silicon.

EXAMPLE 10

The component of any of Examples 1 to 9 can feature a cutting layer that is bonded to the substrate indirectly via an interlayer.

EXAMPLE 11

The component of any of Examples 1 to 10 can feature a cutting layer that is anodically bonded to the interlayer, wherein the interlayer is bonded to the substrate.

EXAMPLE 12

The component of any of Examples 1 to 11 can feature an interlayer comprising a metal.

EXAMPLE 13

The component of any of Examples 1 to 12 can feature a metal interlayer comprising steel, a nickel/iron alloy, Invar, or titanium.

EXAMPLE 14

The component of any of Examples 1 to 13 can feature a metal interlayer comprising a metal that is covalently coated with silicon.

EXAMPLE 15

The component of any of Examples 1 to 14 can be a cutting element, a gage protector, an impact arrestor, or other abrasive or wear-resistant hardfacing component.

EXAMPLE 16

The component of any of Examples 1 to 15 can be attached to a drill bit, a stabilizer, or a reamer.

EXAMPLE 17

A system for making the component of any of Example 1 to 16, such as for making a component, includes an anode, a cathode, the substrate in contact with the thermally stable polycrystalline material, and a current generator for sending a current from the anode to the cathode. The thermally stable polycrystalline material and the substrate are disposed between the anode and the cathode. The anode is in contact with the thermally stable polycrystalline material and the cathode is in contact with the substrate. The current generates an electric field and causes anodic bonding between the thermally stable polycrystalline material and the substrate.

EXAMPLE 18

The system of Example 16 can include a heating element that includes an enclosed compartment for heating and into which the anode, the cathode, the substrate, and the thermally stable polycrystalline material are placed.

EXAMPLE 19

The system of Example 16 can include a heating element that includes one or more heating element components in contact with at least one of the anode, the cathode, the substrate, or the thermally stable polycrystalline material.

EXAMPLE 20

A method of making the component according to any of Examples 1 to 16 includes positioning the thermally stable polycrystalline material in contact with a substrate and positioning the thermally stable polycrystalline material and the substrate between an anode and a cathode. The thermally stable polycrystalline material is in contact with the anode, and the substrate is in contact with the cathode. An electrical current is delivered to the anode to generate an electrical field between the anode and the cathode. The electrical field causes the thermally stable polycrystalline material to be anodically bonded to the substrate.

The foregoing description of certain embodiments and features, including illustrated embodiments, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure. Certain features that are described in this specification in the context of separate embodiments can also be implemented in combination in a single implementation. Conversely, various features that are described in the context of a single implementation can also be implemented in multiple ways separately or in any suitable subcombination. Moreover, although features may be described above as acting in certain combinations, one or more features from a combination can in some cases be excised from the combination, and the combination may be directed to a subcombination or variation of a subcombination. Thus, particular embodiments have been described. Other embodiments are within the scope of the disclosure.

What is claimed is:

1. A component, comprising:

a substrate;

a thermally stable polycrystalline material; and a covalent oxide bonding layer between the substrate and the thermally stable polycrystalline material, the covalent oxide bonding layer being formed as a result of the thermally stable polycrystalline material being anodically bonded to the substrate.

2. The component of claim 1, wherein the thermally stable polycrystalline material comprises polycrystalline diamond or polycrystalline cubic boron nitride.

3. The component of claim 1, wherein the thermally stable polycrystalline material comprises a carbonate.

4. The component of claim 3, wherein the carbonate comprises at least one of magnesium carbonate, silicon carbonate, sodium carbonate, potassium carbonate, strontium carbonate, calcium carbonate, or lithium carbonate.

5. The component of claim 1, wherein the substrate comprises a carbide or a metal.

6. The component of claim 5, wherein the carbide comprises cemented tungsten carbide or silicon carbide.

7. The component of claim 5, wherein the metal comprises steel, a nickel/iron alloy, Invar, or titanium.

8. The component of claim 5, wherein the metal comprises nickel or cobalt.

9. The component of claim 5, wherein the carbide or the metal comprise or are covalently coated with silicon.

10. The component of claim 1, wherein the thermally stable polycrystalline material is bonded to the substrate indirectly via an interlayer.

11. The component of claim 10, wherein the thermally stable polycrystalline material is anodically bonded to the interlayer, and wherein the interlayer is bonded to the substrate.

12. The component of claim 10, wherein the interlayer comprises a metal.

13. The component of claim 12, wherein the metal comprises steel, a nickel/iron alloy, Invar, or titanium.

14. The component of claim 12, wherein the metal is covalently coated with silicon.

15. The component of claim 1, wherein the component is a cutting element, a gage protector, an impact arrestor, or other abrasive or wear-resistant hardfacing component.

16. The component of claim 1, wherein the component is attached to a drill bit, a stabilizer, or a reamer.

* * * * *